US010981414B2

(12) United States Patent
Schuster et al.

(10) Patent No.: US 10,981,414 B2
(45) Date of Patent: Apr. 20, 2021

(54) PAINT CAN SQUEEGEE APPARATUS

(71) Applicant: Danco, Inc., Irving, TX (US)

(72) Inventors: Michael J. Schuster, Shorewood, IL (US); Dwayne A. Porter, Lockport, IL (US)

(73) Assignee: Danco, Inc., Irving, TX (US)

( * ) Notice: Subject to any disclaimer, the term of this patent is extended or adjusted under 35 U.S.C. 154(b) by 79 days.

(21) Appl. No.: 16/437,236

(22) Filed: Jun. 11, 2019

(65) Prior Publication Data

US 2019/0375231 A1 Dec. 12, 2019

Related U.S. Application Data

(60) Provisional application No. 62/683,946, filed on Jun. 12, 2018.

(51) Int. Cl.
*B44D 3/16* (2006.01)
*B44D 3/12* (2006.01)

(52) U.S. Cl.
CPC ..... *B44D 3/128* (2013.01)

(58) Field of Classification Search
CPC ..... B44D 3/128; B44D 3/162; B44D 3/16
USPC ..... 220/736, 701, 700, 694, 695, 698, 699; 15/236.01, 236.07; 30/169
See application file for complete search history.

(56) References Cited

U.S. PATENT DOCUMENTS 3,604,047 A * 9/1971 Hennigan ..... B44D 3/162 15/236.09

* cited by examiner

*Primary Examiner* — James N Smalley
*Assistant Examiner* — Elizabeth J Volz
(74) *Attorney, Agent, or Firm* — Thomas | Horstemeyer, LLP

(57) ABSTRACT

Various embodiments are described for a squeegee apparatus configured to facilitate a removal of paint or other debris in an annular recess of a can, such as a paint can. The squeegee apparatus may include a body having a first recess to receive a first lip of a can, a second recess to receive a second lip of the can, and a projection to extend into an annular recess of the can. The squeegee apparatus may include a guard wall projecting laterally from the body and a ramp at least partially defined by a distal end of the projection. The ramp and the projection can be positioned such that, when the body of the squeegee apparatus is pulled along the annular recess of the paint can, paint or other debris residing in the annular recess is forced up the ramp and redirected towards an interior chamber of the can.

22 Claims, 11 Drawing Sheets

PAINT CAN SQUEEGEE APPARATUS

CROSS-REFERENCE TO RELATED APPLICATION

This application claims the benefit of and priority to U.S. Provisional Patent Application No. 62/683,946 entitled "PAINT CAN SQUEEGEE APPARATUS," filed Jun. 12, 2018, the contents of which being incorporated by reference in their entirety herein.

BACKGROUND

Paint is traditionally sold for residential use in half-pint, pint, quart, and one gallon cylindrical metal cans (hereinafter "paint cans"), typically formed of tin-coated steel. Some paint cans have removable and resealable lids with a downward projecting rim that forms a press fit with an annular recess positioned between an outer lip and an inner lip on a top surface of the paint can. Paint from a paint can is often poured into a painting tray or other container by tipping the paint can. This unavoidably causes paint to flow into and fill the annular recess. When securing a resealable lid to a paint can, any paint residing in the annular recess can result in a less than airtight seal and, as a result, any paint remaining in an interior area of the paint can dry out during storage. As can be appreciated, any paint residing in the annular recess is generally unusable as it cannot be easily accessed or removed from the recess. Moreover, removing a lid having dried paint residing in the annular recess can cause the dried paint to crack and fall into the paint can, mixing with usable paint and rendering the paint unusable.

BRIEF SUMMARY OF THE INVENTION

Various embodiments are described for a squeegee apparatus configured to attach to a can and facilitate a removal of object, such as dust or a liquid, in an annular recess of the can. More specifically, embodiments are described for a squeegee apparatus configured to attach to a paint can and facilitate a removal of paint or other item positioned in an annular recess of the paint can. The squeegee apparatus may include a body having a first channel configured to receive a first lip of the paint can, a second channel configured to receive a second lip of the paint can, and a projection configured to extend into an annular recess of the paint can. Further, the squeegee apparatus may include a guard wall projecting laterally from the body and a ramp at least partially defined by a distal end of the projection. The ramp can be at least partially coupled to an inner portion of the guard wall. The ramp and the projection can be positioned such that, in response to the body of the squeegee apparatus being pulled along the annular recess of a can, paint or other object residing in the annular recess is forced up the ramp and towards an interior chamber of the can.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure relates to a squeegee apparatus configured to attach to a can and facilitate a removal of object, such as saw dust or a liquid, that is positioned in an annular recess of the can. In some embodiments, the squeegee apparatus is configured to attach to a paint can and facilitate a removal of paint or other item or liquid positioned in an annular recess of the paint can. While embodiments described herein generally relate to removal of paint from an annular recess of a paint can, the disclosure is not so limited. For instance, in some embodiments, the squeegee apparatus can be used to remove paint thinner from a paint thinner can, or other debris in any can having an adaptably-sized annular recess.

To this end, in some embodiments, a squeegee apparatus may include a body having a first channel configured to receive a first lip of a can, a second channel configured to receive a second lip of the can, and a projection configured to extend into an annular recess of the can. Further, the squeegee apparatus may include a guard wall projecting laterally from the body and a ramp at least partially defined by a distal end of the projection. The ramp can be at least partially coupled to an inner portion of the guard wall. The ramp and the projection can be positioned such that, in response to the body of the squeegee apparatus being pulled along the annular recess of the can, paint or other object residing in the annular recess is forced up the ramp and towards an interior chamber of the can.

Other features and advantages of the present invention will become apparent from the following description of the invention which refers to the accompanying drawings.

Figure 1:
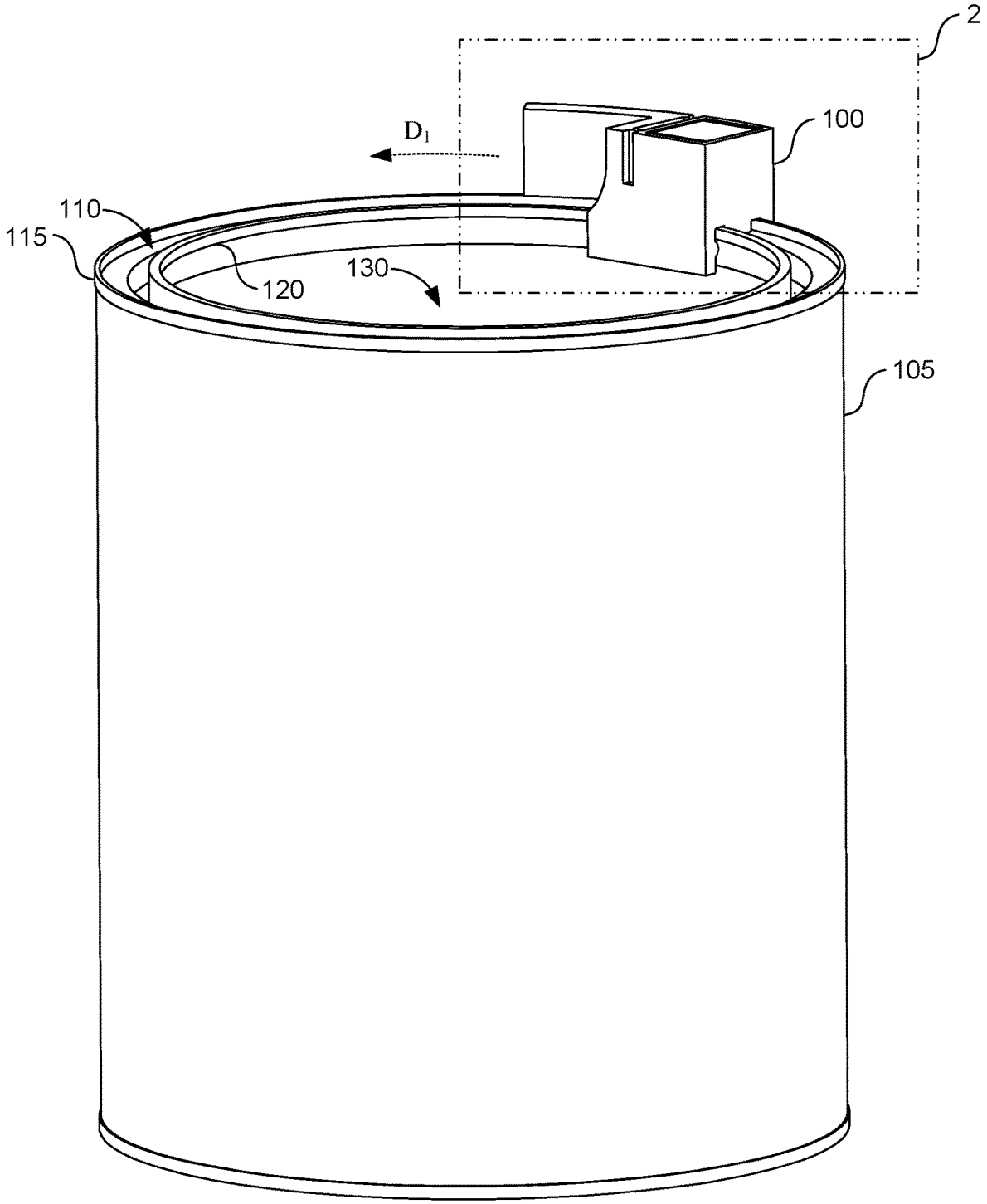
FIG. 1 is a perspective view of a squeegee apparatus coupled to a paint can according to various embodiments of the present disclosure.

Referring now to FIG. 1, a squeegee apparatus 100 is shown coupled to a paint can 105. A callout region 2 is shown for further discussion with respect to FIG. 2. The paint can 105 may include, for example, a half-pint, pint, quart, or one gallon cylindrical metal can in various examples. In is understood that the size and/or position of the various components of the squeegee apparatus 100 can be adjusted based on the size and position of an annular recess 110 of the paint can 105 (or other can).

Notably, the paint can 105 can be sold with a removable and resealable lid (not shown) that includes a downward projecting rim (not shown) that forms a press fit with the annular recess 110 of the paint can 105. Generally, the annular recess 110 includes a recessed region positioned between an outer lip 115 and an inner lip 120 at or near a top of the paint can 105. Paint or other liquid retained in the paint can 105 is often poured into a painting tray or other container (not shown) by tipping the paint can 105, which unavoidably causes paint to flow into and sometimes fill the annular recess 110. When securing a resealable lid to the paint can 105, any paint residing in the annular recess 110 can result in a less than airtight seal. Any paint remaining in an interior 130 of the paint can 105 may dry out during storage due to the poor seal. Additionally, any paint residing in the annular recess 110 is unusable as it cannot be easily accessed or removed from the annular recess 110. Also, the paint residing in the annular recess 110 is subject to cracking or otherwise impairing the seal of the paint can 105 and/or the quality of paint or other liquid residing therein.

According to various embodiments, the squeegee apparatus 100 can be configured to attach to the paint can 105 and facilitate a removal of paint or other debris in the annular recess 110, and perform other functions as will be described. For instance, the squeegee apparatus 100 can be gripped by a hand of an operator and pulled or pushed along the annular recess 110 or, in other words, along the perimeter of the paint can 105 denoted in FIG. 1 by direction $D_1$. By virtue of the components of the squeegee apparatus 100, any paint or debris residing in the annular recess 110 will be forced upwards and redirected towards the interior 130 of the paint can 105 such that the paint or debris residing in the annular recess 110 is redirected towards an interior 130 of the paint can 105. However, while FIG. 1 denotes a direction $D_1$, it is understood that the components and techniques discussed herein could be applied to another side of the squeegee apparatus 100 such that paint can be removed from the annular recess 110 by pushing or pulling the squeegee apparatus 100 in either direction (e.g., in a direction opposite that of $D_1$).

Figure 2:
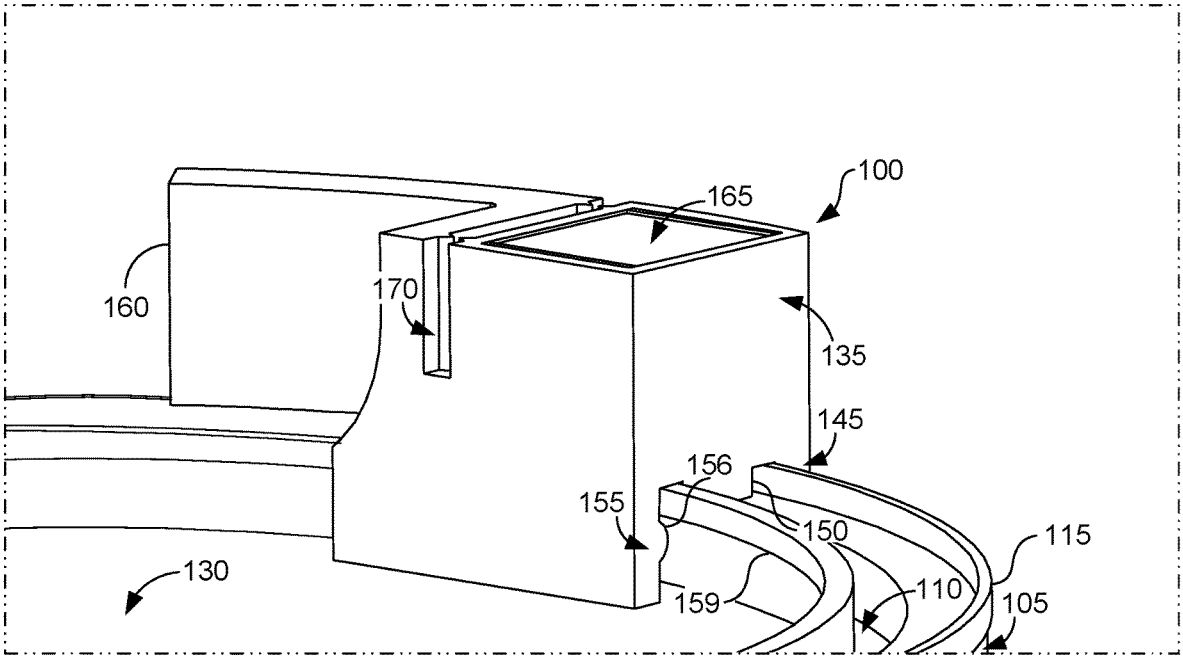
FIG. 2 is an enlarged view of a callout region of FIG. 1.

Turning now to FIG. 2, an enlarged view of a callout region 2 of FIG. 1 is shown to better illustrate the coupling formed between the squeegee apparatus 100 and the paint can 105. The squeegee apparatus 100 may include a body 135 having various channels 140*a*, 140*b* (collectively "channels 140"). For instance, the body 135 may include a first channel 140*a* configured to receive the outer lip 115 of the paint can 105 and a second channel 140*b* configured to receive an inner lip 120 of the paint can 105. The first channel 140*a* can be defined by an area between a first body wall 145 and a downwardly extending projection 150 (hereinafter "projection 150"), where the first body wall 145 may extend below the outer lip 115 of the paint can 105 in some embodiments. Similarly, the second channel 140*b* can be defined by an area between a second body wall 155 and the projection 150, where the second body wall 155 may extend below the inner lip 120 of the paint can 105 in some embodiments.

Further, the squeegee apparatus 100 may include a protrusion 156 configured to come into contact with a ridge 159 or a bottom surface of the inner lip 120. As such, when upward forces are applied to the squeegee apparatus, as will be discussed, the protrusion 156 may prevent the squeegee apparatus 100 from being removed from the paint can 105 unless sufficient force is applied. The protrusion 156 can be square, semi-circular, triangular, or other shape as can be appreciated.

Additionally, the body 135 of the squeegee apparatus 100 can be sized and shaped to facilitate being held and gripped by a hand of an operator. To this end, in some embodiments, the body 135 can be substantially rectangular-shaped, square-shaped, or the body 135 may assume another suitable shape. For example, the body 135 can be economically contoured to facilitate gripping by the user between a side of a forefinger and a thumb of an operator.

The projection 150 of the body 135 can be configured to extend into the annular recess 110 of the paint can 105, for instance, between the outer lip 115 and the inner lip 120, when the outer lip 115 and the inner lip 120 are positioned in respective ones of the channels 140. In some embodiments, the projection 150 may have a width substantially similar to a width of the annular recess 110, thereby forming a seal between the outer lip 115 and the inner lip 120. The seal may prevent seepage of paint as the squeegee apparatus 100 is pulled along the annular recess 110, as can be appreciated. A first distal end of the projection 150 shown in FIG. 2 may include a flat surface having a common plane with a side surface of the body 135.

Further, the squeegee apparatus 100 may include a guard wall 160 projecting laterally from the body 135 of the squeegee apparatus 100. The guard wall 160 may prevent seepage of paint onto an exterior surface of the paint can 105 when paint is forced upwards, as will be described. Generally, the guard wall 160 projects above a top surface of the paint can 105 and, more specifically, above a top surface of the outer lip 115. Further, in some embodiments, at least a portion of the guard wall 160 (e.g., the portion not positioned above the outer lip 115) can be disposed below the outer lip 115 of the paint can 105, for instance, to retain paint within a perimeter of the paint can 105 and prevent seepage of paint onto the exterior surface of the paint can 105. In other words, at least a portion of the guard wall 160 can be disposed below a top surface of the paint can 105 to form a seal between the squeegee apparatus 100 and a ridge of the outer lip 115.

In various embodiments, a bottom surface of the projection 150, or other surface in the channels 140, may comprise a magnet or other suitable component that causes a magnetic coupling between the squeegee apparatus 100 and the paint can 105. In alternative embodiments, the magnet can be disposed within the body 135 or other portion of the squeegee apparatus 100 using molding, secondary operation, secondary part, or other similar manufacturing process. Further, in various embodiments, the body 135 may include a hollow interior chamber 165 and a slit 170, as will be described.

Figure 3:
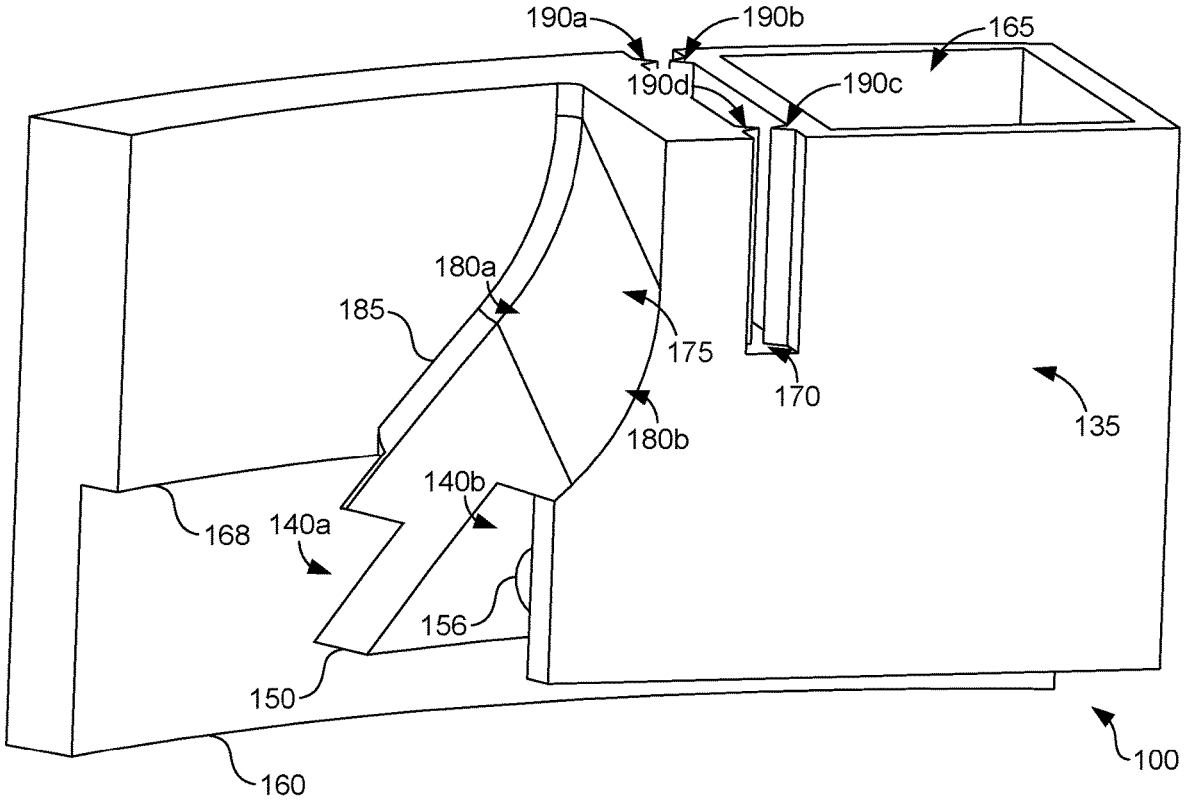
FIG. 3 is a perspective view of the squeegee apparatus according to various embodiments of the present disclosure.

Referring next to FIG. 3, another perspective view of the squeegee apparatus 100 is shown according to various embodiments. As apparent from FIG. 3, the squeegee apparatus 100 may further include a ramp 175 at least partially defined by a second distal end of the projection 150 (e.g., opposite the first distal end of the projection 150 shown in FIG. 2). The ramp 175 can be at least partially coupled to an inner portion of the guard wall 160 in some embodiments. The ramp 175 and the projection 150 can be positioned such that, in response to the body 135 of the squeegee apparatus 100 being pulled along the annular recess 110 of the paint can 105, any paint residing in the annular recess 110 is forced up the ramp 175 and towards a direction of the interior 130 of the paint can 105.

As shown in FIG. 3, in some embodiments, the ramp 175 may have a curved incline resembling, e.g., an exponential curve. In other words, the ramp 175 may include a partially-twisting ramp, meaning at least a portion of the ramp 175 is twisted or torqued. However, in alternative embodiments, the ramp 175 may have a straight incline. Also shown in FIG. 2, in various embodiments, at least a portion of the ramp 175 can be twisted or torqued such that a first side 180*a* of the ramp 175 has a height greater than a second side 180*b* of the ramp 175. Additionally, the ramp 175 may include a sidewall 185 that facilitates coupling of the ramp 175 to the guard wall 160. A base portion of the ramp 175, that includes an inclined distal end of the projection 150, can be shaped to provide the channels 140*a*, 140*b* through which the outer lip 115 and the inner lip 120 of the paint can 105 can be pulled.

In some implementations, the guard wall 160 may include a ridge 168. By virtue of the ridge 168, the thickness of the guard wall 160 may vary so that, when the squeegee apparatus 100 is positioned on the rim of the paint can 105, a lower portion of the guard wall 160 located below the upper edge of the outer lip 115 has a first thickness and an upper portion of the guard wall 160 located above the outer lip 115 has a second, larger thickness that allows the upper portion of the guard wall 160 to extend inward over the upper edge of the outer lip 115. In other words, the ridge 168 may rest on a top surface of the paint can 105, while the portion of the guard wall 160 located below the ridge 168 rests against an exterior surface of the paint can 105. In this configuration, the gap between the outer surface of the paint can 105 and the lower portion of the guard wall 160 is covered by the upper portion, which can help prevent paint removed from the annular recess 110 from leaking between the guard wall 106 and the paint can 105.

Further, in some embodiments, the body 135 may include a slit 170 or, in other words, a narrow opening that is positioned between the ramp 175 and the body 135 of the squeegee apparatus 100. To this end, the squeegee apparatus 100 may include slit projections 190*a* . . . 190*d* (collectively "slit projections 190") that extend into the slit 170 in some embodiments. The slit 170 and the slit projections 190 can be sized and positioned to remove paint or debris from a tool having a narrow, flat blade as the tool is swiped through the slit 170, such as a drywall scraper, paint scraper, or other tool having a flat surface. Also, the slit projections 190 can be used to retain a tool having a flat blade, such as a drywall scraper, in the slit 170, for instance, when the tool is not in use. In various embodiments, the slit 170 can be an opening that is formed in a mold or during a secondary operation (e.g., cutting after manufacturer), thus eliminating projections 190*a* . . . 190*d* in some embodiments.

Figure 4:
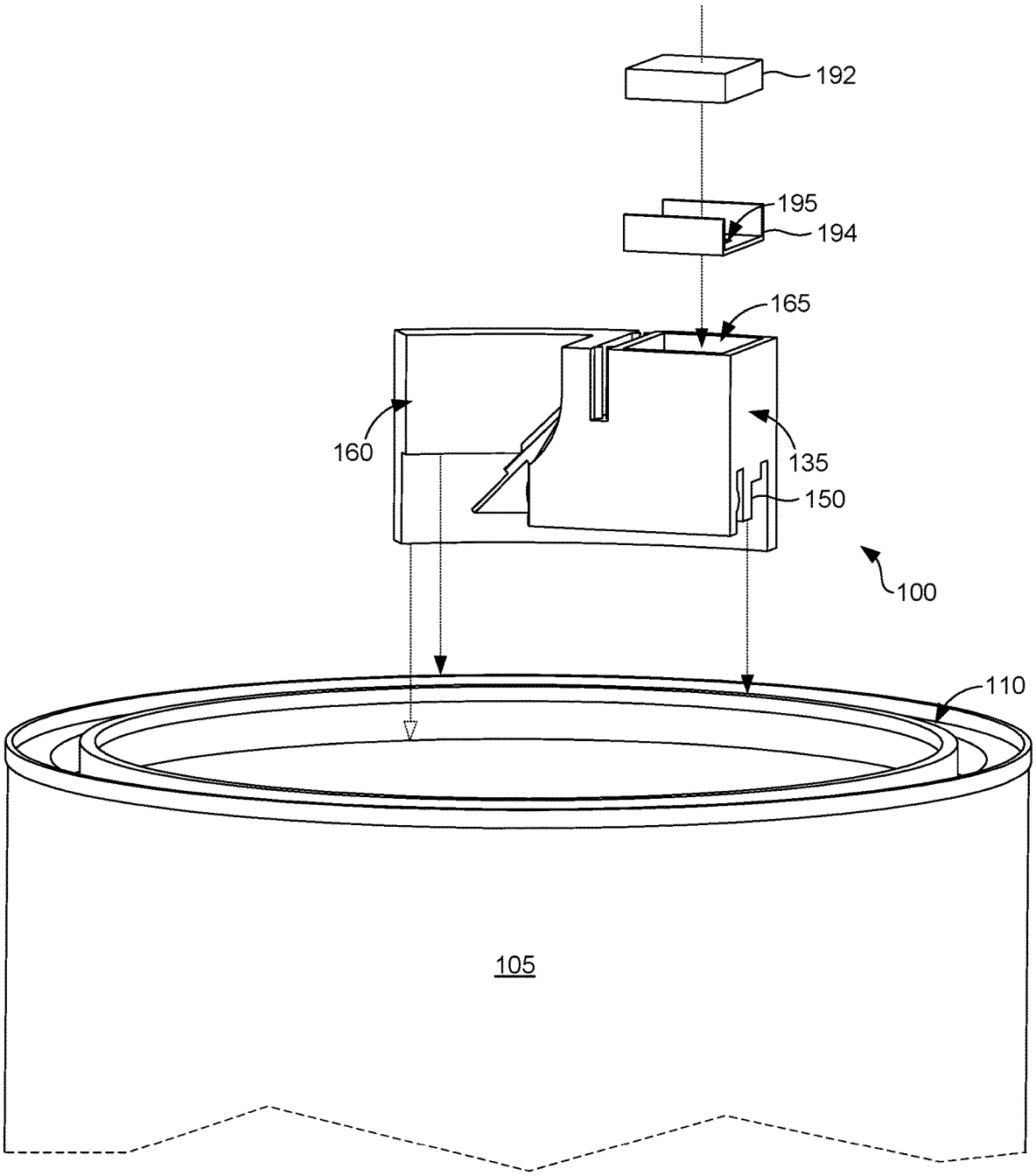
FIG. 4 is an exploded perspective view of the squeegee apparatus decoupled from the paint can according to various embodiments of the present disclosure.

Turning now to FIG. 4, an exploded view of the squeegee apparatus 100 is shown relative to the paint can 105. In various embodiments, the squeegee apparatus 100 may include a magnet 192 and a magnet support bracket 194 being configured to retain the magnet in the hollow interior chamber 165 of the body 135. For instance, the magnet support bracket 194 can be configured to retain the magnet 192 at a predefined distance from a top of the squeegee apparatus 100. To this end, the magnet 192 can be retained at a predefined distance sufficient to magnetically couple and retain a paint brush or other tool having a magnetic body to a top surface of the squeegee apparatus 100. While FIG. 4 illustrates the magnet 192 and the magnet support bracket 194, in some embodiments, the magnet 192 can be installed in the hollow interior chamber 165 without the magnet support bracket 194. To this end, the magnet 192 can be held in place by an adhesive or may form a friction fit with the walls of the hollow interior chamber 165.

In some embodiments, the hollow interior chamber 165 has a surface at a predefined depth sufficient to retain the magnet 192 and/or the magnet support bracket 194. The magnet support bracket 194 may include a bracket having three or more sides with an opening sufficient to form an interference fit with the magnet 192. In various embodiments, a bottom surface of the magnet support bracket 194 may include an aperture 195. As such, adhesive can be applied in the aperture 195 to couple the magnet support bracket 194 to a surface located in the hollow interior chamber 165. Additionally, the adhesive can be used to couple the magnet 192 to both the magnet support bracket 194 and the surface located in the hollow interior chamber 165 of the body 135. In various embodiments, as the body 135 can be substantially rectangular-shaped or square-shaped, the magnet 192 and/or the magnet support bracket 194 are also substantially rectangular-shaped or square-shaped (or other shape as can be appreciated) and may include a size sufficient to form an interference fit with the body 135 when the magnet 192 and/or the magnet support bracket 194 are positioned in the hollow interior chamber 165.

Figure 5:
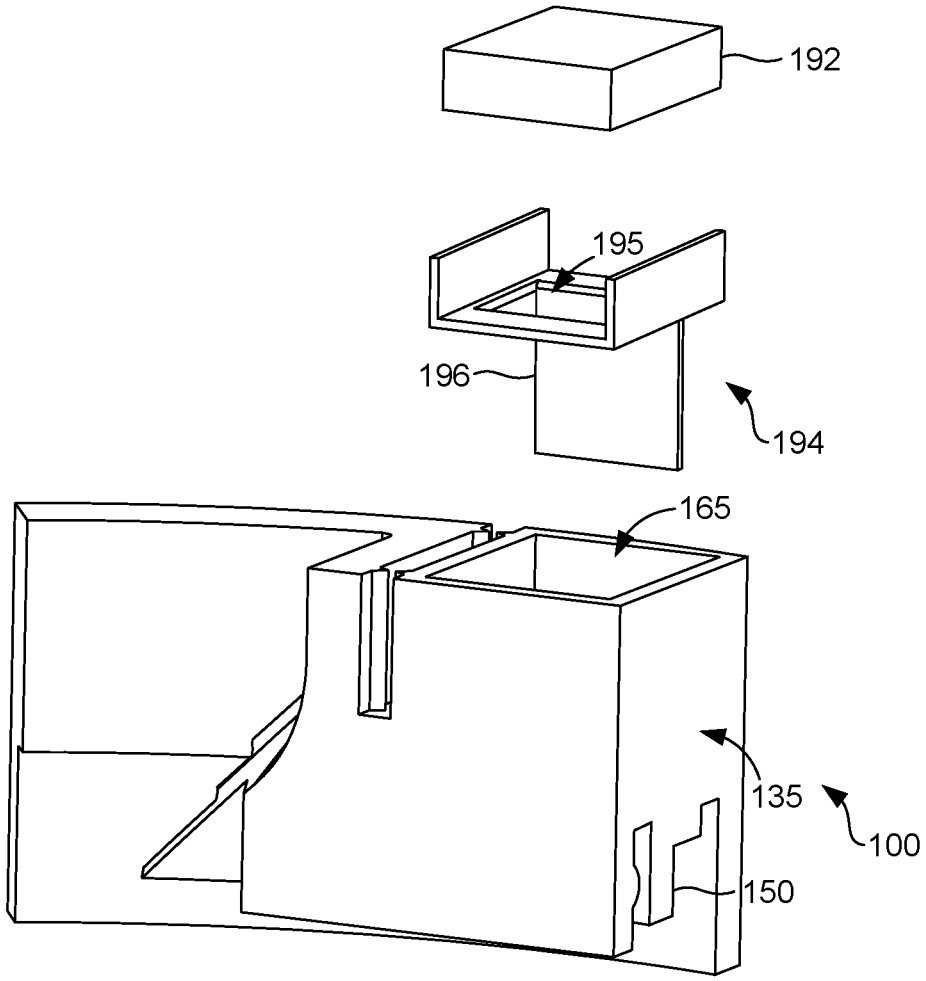
FIG. 5 is another exploded perspective view of the squeegee apparatus decoupled from the paint can according to various embodiments of the present disclosure.

FIG. 5 illustrates an alternative example for the magnet support bracket 194 according to various embodiments. Similar to FIG. 4, the magnet support bracket 194 may include an aperture 195. However, the magnet support bracket 194 may further include a fin 196 extending downward from a base of the magnet support bracket 194. The fin 196 may permit the magnet 192 to be positioned as a predefined distance in the hollow interior chamber 165 such that the magnet 192 magnetically couples to the top surface of the paint can 105 as well as to any tools positioned on the top surface of the squeegee apparatus 100, as will be discussed.

Figure 6:
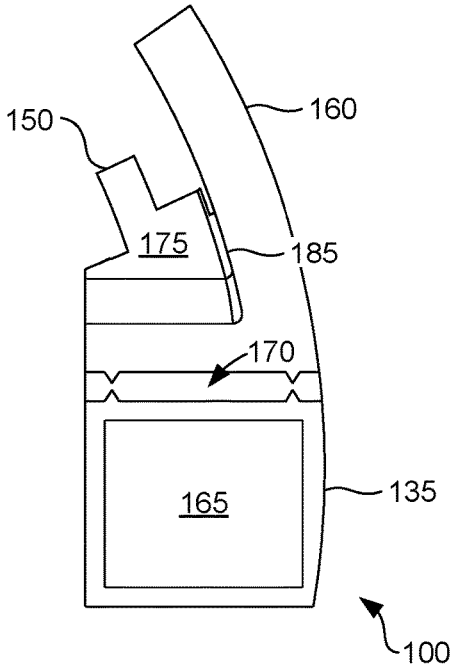
FIG. 6 is a top view of the squeegee apparatus according to various embodiments of the present disclosure.
Figure 7:
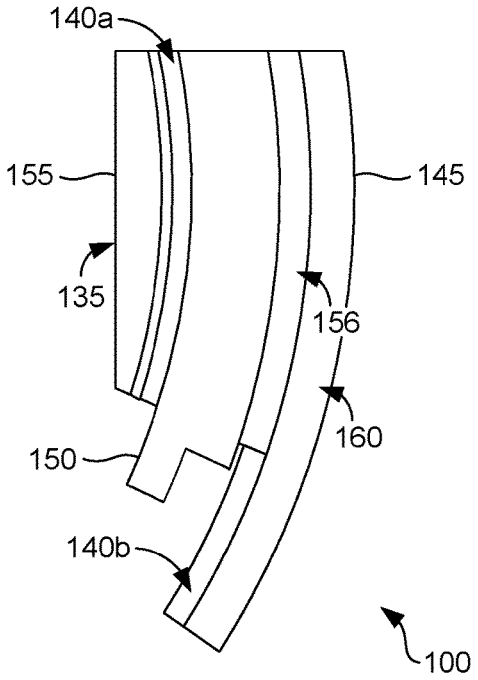
FIG. 7 is a bottom view of the squeegee apparatus according to various embodiments of the present disclosure.
Figure 8:
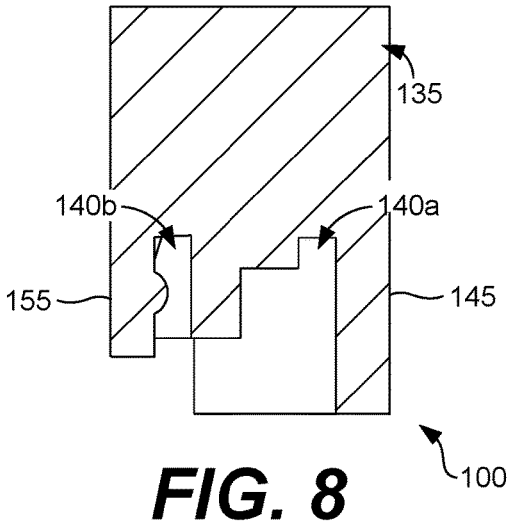
FIG. 8 is a rear view of the squeegee apparatus according to various embodiments of the present disclosure.
Figure 9:
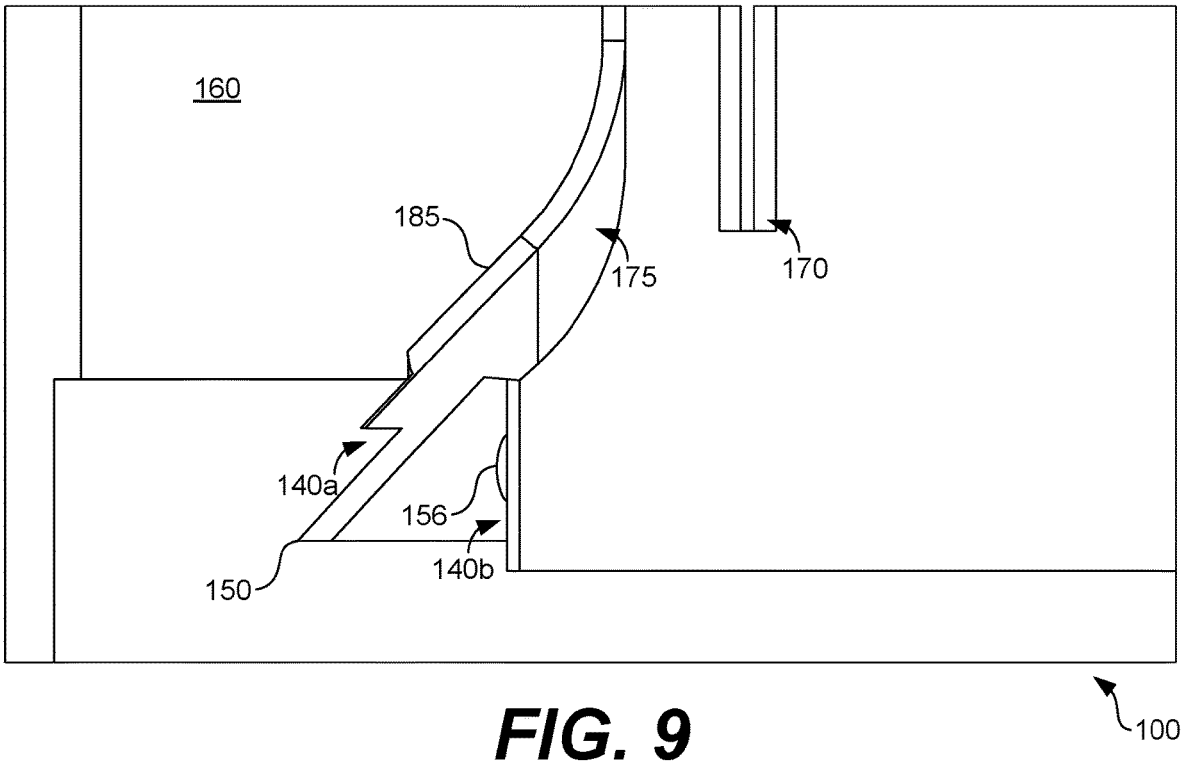
FIG. 9 is a side view of the squeegee apparatus according to various embodiments of the present disclosure.

Additional views of the squeegee apparatus 100 are provided in FIGS. 6-9. Specifically, FIG. 6 shows a top view of the squeegee apparatus 100 according to various embodiments of the present disclosure. FIG. 7 illustrates a bottom view of the squeegee apparatus 100. Notably, in FIG. 7, the projection 150, the first body wall 145, the second body wall 155, the first channel 140*a*, the second channel 140*b*, the protrusion 156, and the guard wall 160 are shown as being curved, for instance, to conform to a curvature of the paint can 105. FIG. 8 depicts a rear view of the squeegee apparatus 100 according to various embodiments of the present disclosure. Finally, FIG. 9 shows a side, perspective view of the squeegee apparatus 100 according to various embodiments of the present disclosure.

Figure 10:
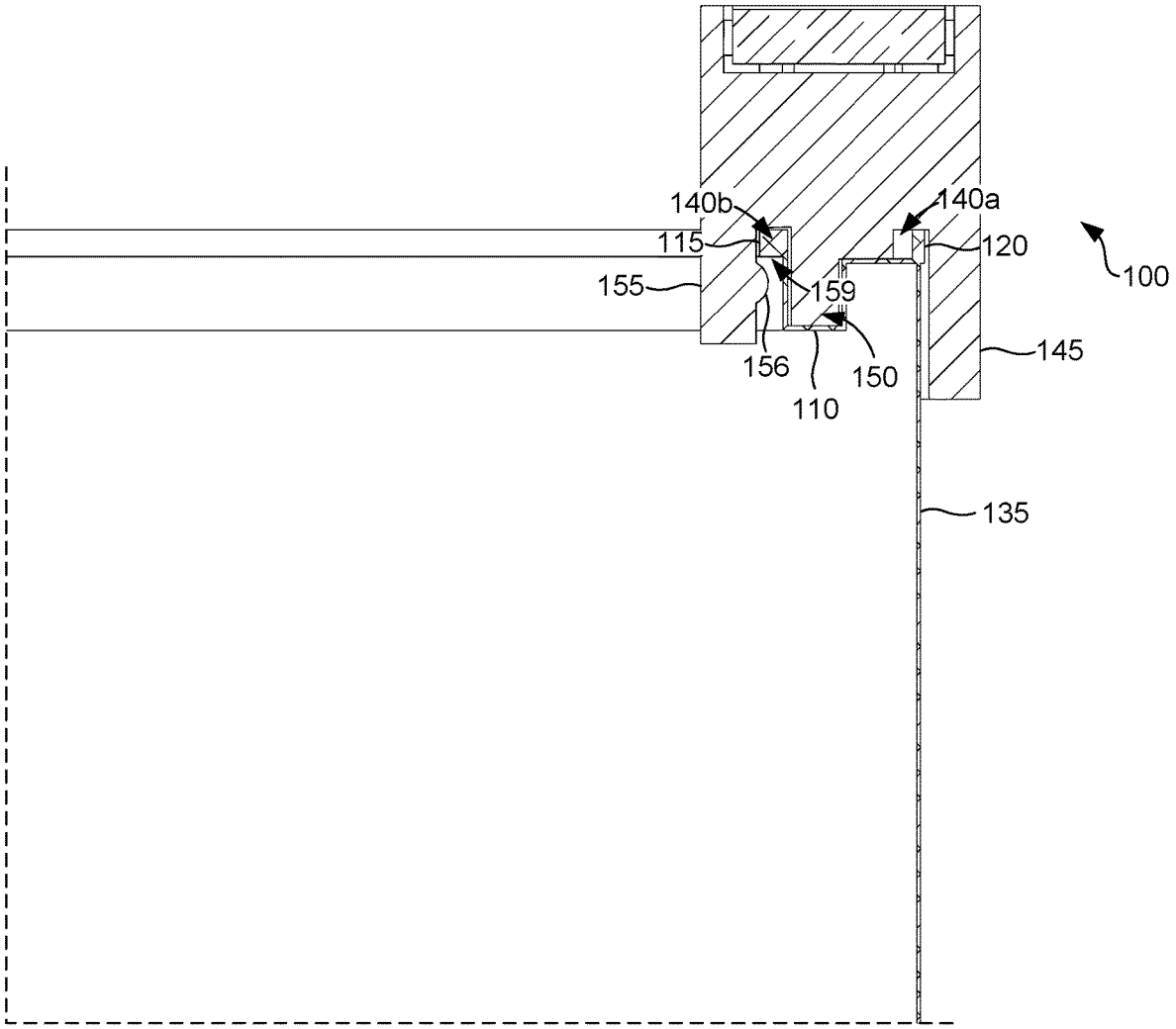
FIG. 10 is a cross-section view of the squeegee apparatus coupled to the paint can according to various embodiments of the present disclosure.

Moving along to FIG. 10, a cross-section view of the squeegee apparatus 100 is shown coupled to a cross-section of the paint can 105 according to various embodiments of the present disclosure. Notably, FIG. 10 illustrates the positioning of the outer lip 115 and the inner lip 120 of the paint can 105 in the channels 140*a*, 140*b* of the squeegee apparatus 100. Additionally, FIG. 10 illustrates that the first channel 140*a* can be defined as an area between a first body wall 145 and the projection 150, where the first body wall 145 may extend below the outer lip 115 of the paint can 105 in some embodiments. Similarly, the second channel 140*b* can be defined by an area between a second body wall 155 and the projection 150, where the second body wall 155 may extend below the inner lip 120 of the paint can 105 in some embodiments.

The projection 150 is shown being positioned in the annular recess 110 of the paint can 105. Further, the protrusion 156 of the squeegee apparatus 100 is shown as being outwardly extending from the second body wall 155 to come into contact with the ridge 159 or a bottom surface of the inner lip 120. As such, when upward forces are applied to the squeegee apparatus 100, as will be discussed, the protrusion 156 may prevent the squeegee apparatus 100 from being removed from the paint can 105 unless sufficient force is applied.

Figure 11:
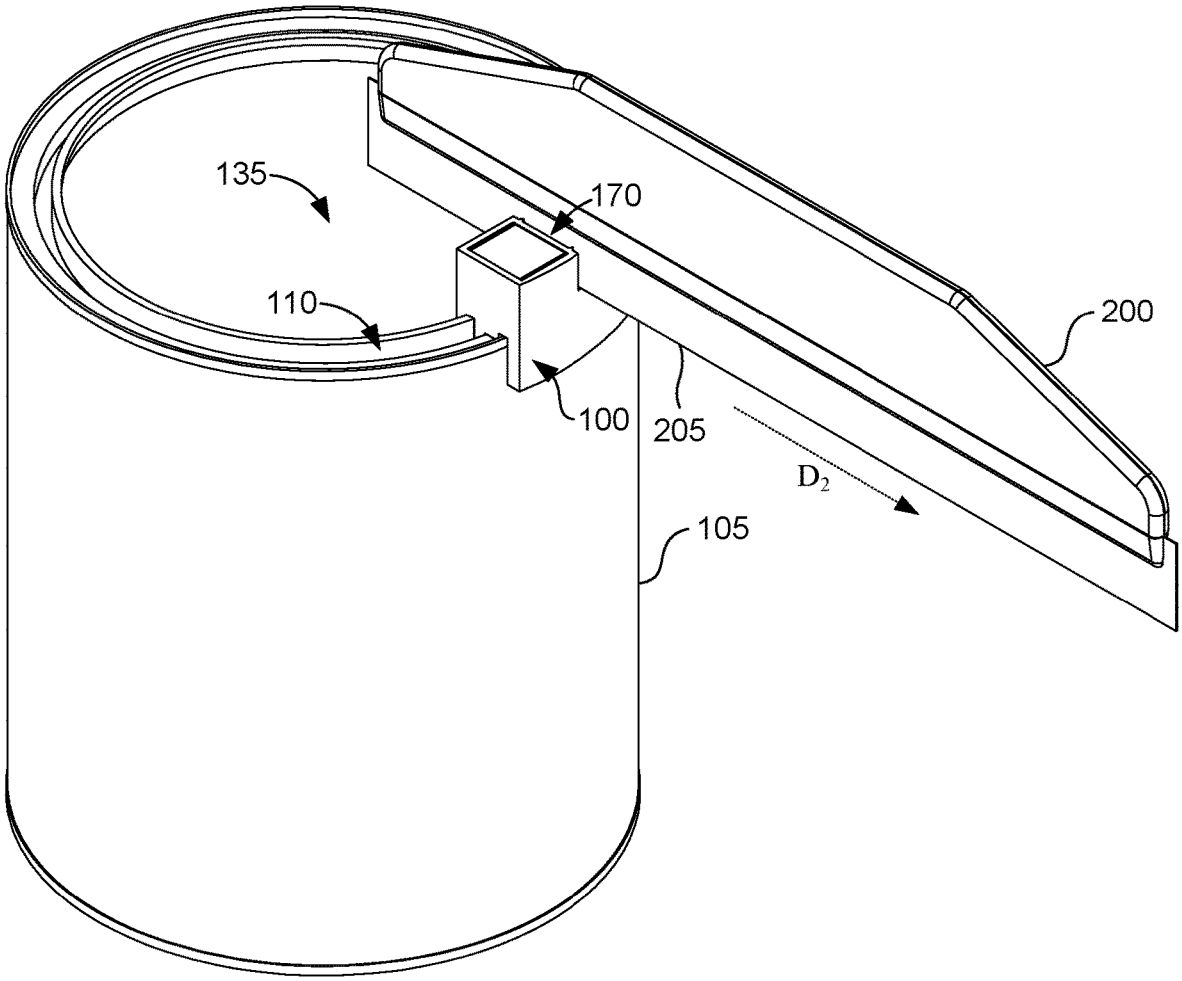
FIG. 11 is a top, perspective view of the squeegee apparatus coupled to the paint can, where a tool is coupled to the squeegee apparatus according to various embodiments of the present disclosure.

FIG. 11 is a top, perspective view of the squeegee apparatus 100 coupled to the paint can 105, where a tool 200, such as a paint scraper, is coupled to the squeegee apparatus 100. The body 135 is shown having a slit 170 or a narrow opening that is positioned between the ramp 175 and the body 135 of the squeegee apparatus 100. The squeegee apparatus 100 may include slit projections 190*a*, 190*b* that extend into the slit 170 in some embodiments. As noted above, the slit projections 190 can be sized and positioned to remove paint or debris from the tool 200 having a blade 205 as the tool 200 is swiped through the slit 170 in a direction defined by $D_2$. The tool 200 may include a drywall scraper, paint scraper, or other tool having a similar type of blade 205 or flat surface. Any paint residing on the blade 205 can be pulled off by the slit 170 and/or the slit projections 190 such that any paint removed falls into the interior 130 of the paint can 105. Also, the slit projections 190 can be used to retain a tool having a flat blade, such as a drywall scraper, in the slit 170, for instance, when the tool is not in use.

Figure 12:
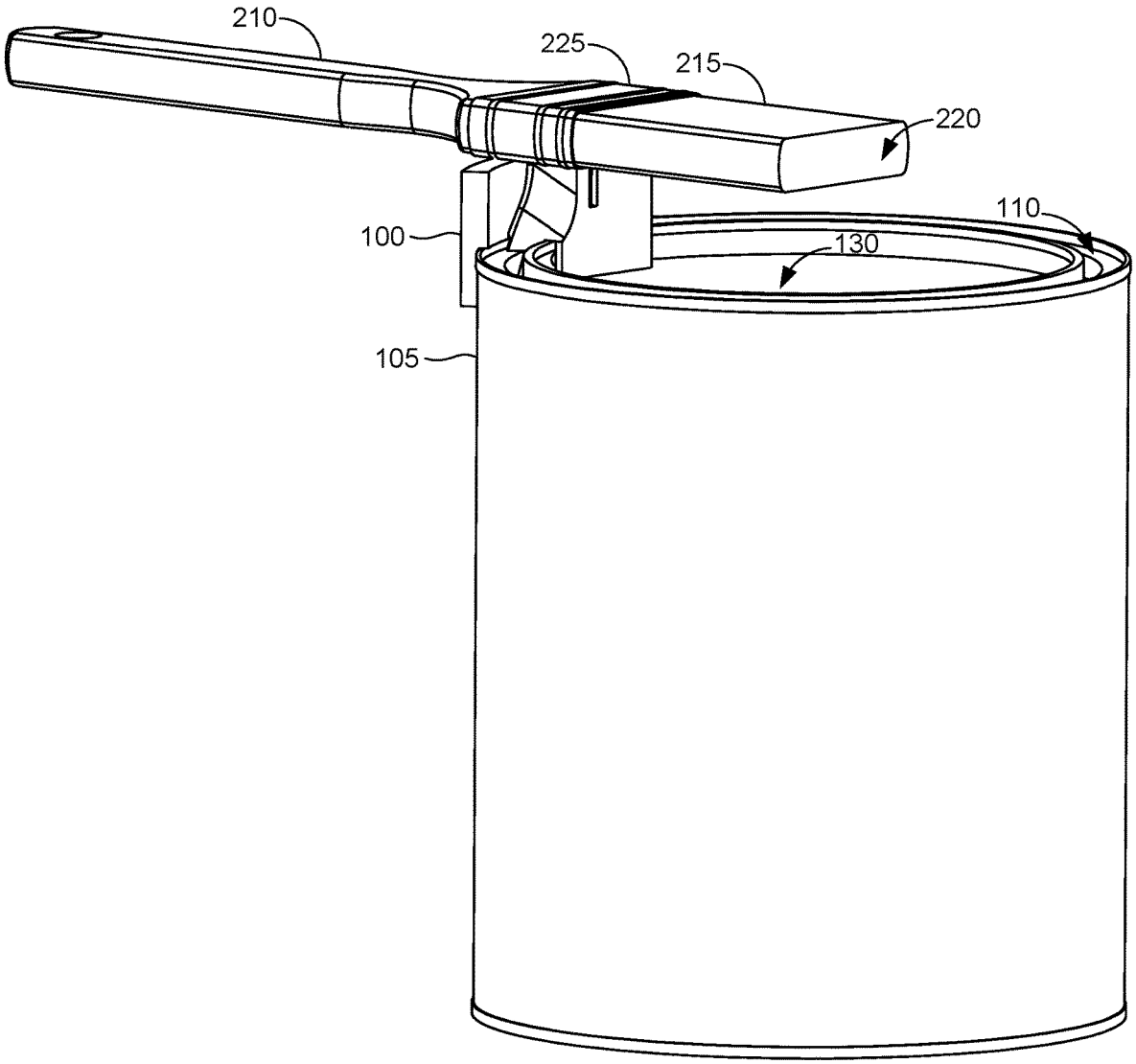
FIG. 12 is a top, perspective view of the squeegee apparatus coupled to the paint can, where a paint brush is magnetically coupled to the squeegee apparatus according to various embodiments of the present disclosure.

FIG. 12 is a top, perspective view of the squeegee apparatus 100 coupled to the paint can 105, where a paint brush 210 is magnetically coupled to the squeegee apparatus 100. As noted above, the squeegee apparatus 100 may include a magnet 192 and a magnet support bracket 194. For instance, the magnet support bracket 194 can be configured to retain the magnet 192 at a predefined distance from a top of the squeegee apparatus 100 sufficient to magnetically couple and retain the paint brush 210 or other tool having a magnetic body to a top surface of the squeegee apparatus 100. Due to the positioning of the magnet 192 on the squeegee apparatus 100, the paint brush 210 can be situated with the brush bristles 215 and brush toe 220 overhanging the interior 130 of the paint can 105 such that any paint on the brush bristles 215 drips into the interior 130. In some embodiments, a magnetic portion of the paint brush 210, such as a ferrule 225, may magnetically couple to the magnet 192 positioned in the squeegee apparatus 100.

Figure 13:
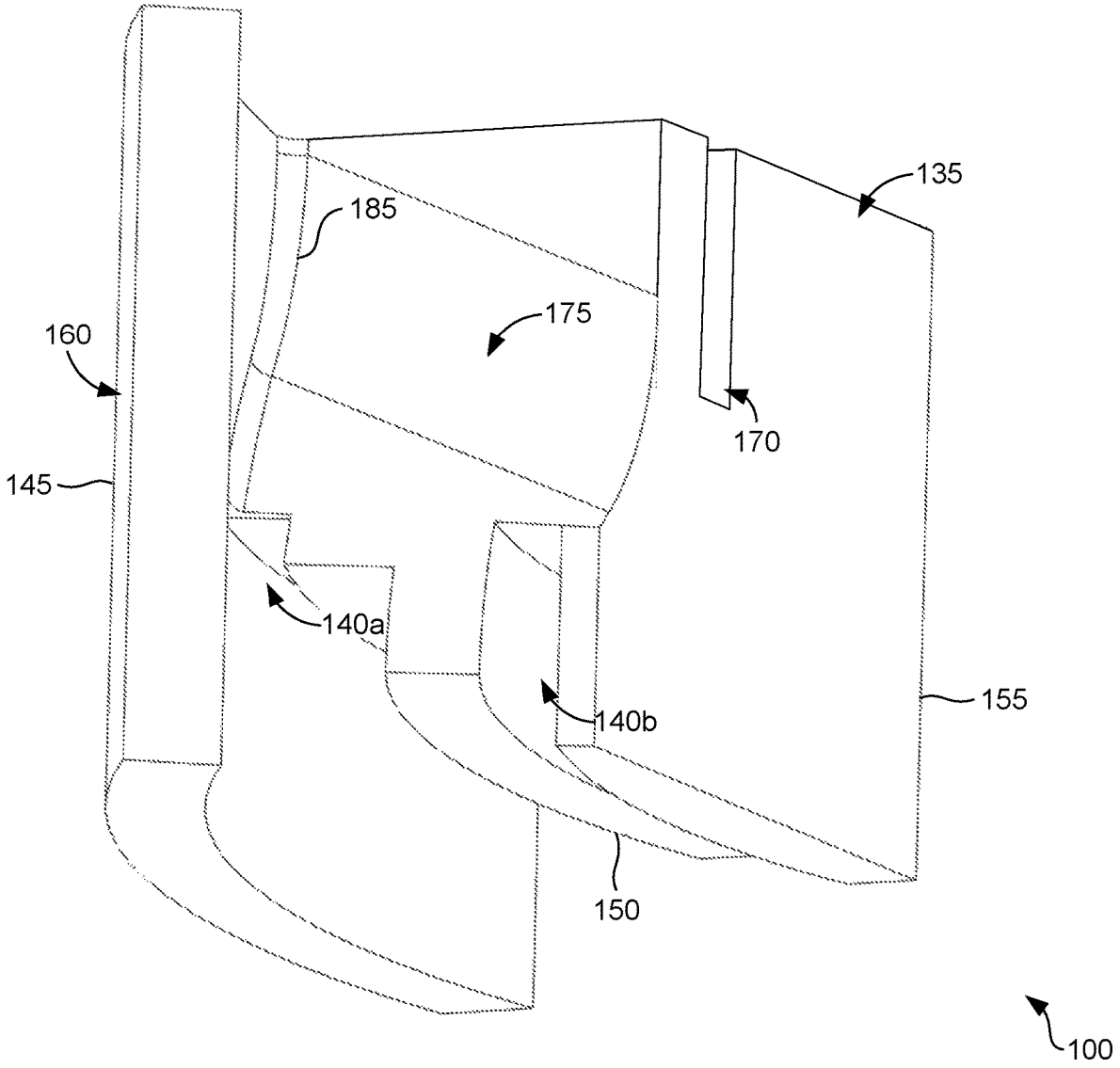
FIG. 13 is a bottom, perspective view of the squeegee apparatus according to various embodiments of the present disclosure.

FIG. 13 is a bottom, perspective view of the squeegee apparatus 100 according to various embodiments of the present disclosure. In FIG. 13, the projection 150 is shown having a tiered or stepped body. In other words, a first portion of the projection 150 may extend downward from the ramp 175 for a first predefined distance while a second portion of the projection 150 extends downward from the ramp 175 for a second predefined distance, where the first predefined distance is less than the second predefined distance. The shape of the projection 150 is further illustrated in the cross-section view of the squeegee apparatus 100 shown in FIG. 8.

All or a portion of the squeegee apparatus 100, excluding the magnet 192, may comprise and be formed from at least one plastic material, such as natural rubber (polyisoprene), flexible PVC, thermoplastic elastomers (TPE), TPR, styrene-butadiene-rubber (SBR), ethylene propylene diene monomer rubber (EPDM), butylrubber, polyurethane rubber, neoprene CR (polychloroprene), hydrogenated nitrile, chlorosulfonated polyethylene (CSPE) synthetic rubber (CSM), chlorosulfonated polyethylene (CSM), nitrile (NBR), acrylic alkyl acrylate copolymer (ACM), silicone rubber, fluorosilicone (FVMQ), fluorocarbon (FKM), tetrafluoroethylene-propylene, or similar materials. Additionally, all or a portion of the squeegee apparatus 100, excluding the magnet 192, may include or be formed from at least one plastic material, such as ABS, polycarbonate-ABS (PC/ABS), polyetherimide (PEI), polyphthalamide (PPA), polystyrene, liquid crystal polymer (LCP), noryl, xylex, xenoy, urethane, nylon, polyether ether ketone (PEEK), polyphenylene sulfide (PPS), PPS PP, POM, PVC, chlorinated PVC (CPVC), or other plastic materials.

While various embodiments discussed herein describe example implementations of the squeegee apparatus 100 with respect to paint cans 105, the embodiments described herein are not limited to paint cans 105 as the squeegee apparatus 100 may also be implemented on cans having other types of content (whether solid, liquid, powdered, etc.) stored therein.

Disjunctive language such as the phrase "at least one of X, Y, or Z," unless specifically stated otherwise, is otherwise understood with the context as used in general to present that an item, term, etc., can be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications can be made to the above-described embodiment(s) without departing substantially from the spirit and principles of the disclosure. All such modifications and variations are intended to be included herein within the scope of this disclosure and protected by the following claims.

Therefore, the following is claimed:

1. A squeegee apparatus configured to attach to a can, comprising:

a body comprising:

a first channel configured to receive a first lip of the can;

a second channel configured to receive a second lip of the can;

a projection configured to extend into an annular recess of the can positioned between the first lip and the second lip;

a hollow interior chamber; and a magnet positioned in the hollow interior chamber of the body at a predefined distance from a top surface of the squeegee apparatus;

a guard wall projecting laterally from the body; and a ramp at least partially defined by a first distal end of the projection, the ramp being coupled to an inner portion of the guard wall, the ramp and the projection being positioned such that, in response to the body being moved along the annular recess of the can, debris residing in the annular recess is forced up the ramp and towards an interior chamber of the can.

2. The squeegee apparatus of claim 1, wherein:

the first distal end of the projection is angled and forms a bottom portion of the ramp; and a second distal end of the projection comprises a flat surface having a common plane with a side surface of the body.

3. The squeegee apparatus of claim 1, wherein the projection has a width substantially similar to a width of the annular recess to form a seal between the first lip and the second lip.

4. The squeegee apparatus of claim 1, wherein the second channel comprises a protrusion projecting laterally from a surface wall, the protrusion being configured to engage a bottom surface of an inner lip of the can.

5. The squeegee apparatus of claim 1, further comprising a slit positioned between the ramp and the body.

6. The squeegee apparatus of claim 5, further comprising a plurality of projections extending into the slit, wherein the plurality of projections are sized and positioned to remove paint or debris from a tool having a flat blade as the tool is swiped through the slit.

7. The squeegee apparatus of claim 1, wherein the ramp has a flat incline or a curved incline.

8. The squeegee apparatus of claim 7, wherein at least a portion of the ramp is twisted such that a first side of the ramp adjacent to the guard wall has a height greater than a second side of the ramp.

9. The squeegee apparatus of claim 1, wherein the can is a paint can and the debris is paint residing in the annular recess of the paint can.

10. The squeegee apparatus of claim 9, wherein:

the first lip of the paint can is an outer lip;

the second lip of the paint can is an inner lip; and at least a portion of the guard wall is disposed below the outer lip when the squeegee apparatus is attached to the paint can.

11. The squeegee apparatus of claim 9, wherein:

the first lip of the paint can is an outer lip;

the second lip of the paint can is an inner lip;

the first channel is defined by an area between a first body wall and the projection, the first body wall extending below the inner lip of the paint can when the squeegee apparatus is attached to the paint can; and the second channel is defined by an area between a second body wall and the projection, the second body wall being a lower portion of the guard wall and extending below the outer lip of the paint can when the squeegee apparatus is attached to the paint can.

12. The squeegee apparatus of claim 11, wherein the projection, the first body wall, the second body wall, the first channel, the second channel, and the guard wall are curved to conform to a curvature of the paint can.

13. The squeegee apparatus of claim 1, further comprising a magnet support bracket being configured to retain the magnet at the predefined distance from the top surface of the squeegee apparatus.

14. The squeegee apparatus of claim 13, wherein the magnet is positioned to apply a magnetic coupling with a top surface of the can.

15. The squeegee apparatus of claim 14, wherein the body, the magnet, and the magnet support bracket are substantially rectangular-shaped or square-shaped.

16. The squeegee apparatus of claim 13, wherein the predefined distance is sufficient to magnetically retain a paint brush or other tool having a magnetic body to the top surface of the squeegee apparatus.

17. A squeegee apparatus configured to attach to a can, comprising:

a body comprising:

a first channel configured to receive a first lip of the can;

a second channel configured to receive a second lip of the can; and a projection configured to extend into an annular recess of the can positioned between the first lip and the second lip;

a guard wall projecting laterally from the body;

a ramp at least partially defined by a first distal end of the projection, the ramp being coupled to an inner portion of the guard wall, the ramp and the projection being positioned such that, in response to the body being moved along the annular recess of the can, debris residing in the annular recess is forced up the ramp and towards an interior chamber of the can; and a slit positioned between the ramp and the body.

18. The squeegee apparatus of claim 17, further comprising a plurality of projections extending into the slit, wherein the plurality of projections are sized and positioned to remove paint or debris from a tool having a flat blade as the tool is swiped through the slit.

19. A squeegee apparatus configured to attach to a can, comprising:

a body comprising:

a first channel configured to receive a first lip of the can;

a second channel configured to receive a second lip of the can;

a projection configured to extend into an annular recess of the can positioned between the first lip and the second lip;

a guard wall projecting laterally from the body; and a ramp at least partially defined by a first distal end of the projection, the ramp being coupled to an inner portion of the guard wall, the ramp and the projection being positioned such that, in response to the body being moved along the annular recess of the can, debris residing in the annular recess is forced up the ramp and towards an interior chamber of the can, wherein:

the ramp has a flat incline or a curved incline; and at least a portion of the ramp is twisted such that a first side of the ramp adjacent to the guard wall has a height greater than a second side of the ramp.

20. A squeegee apparatus configured to attach to a can, comprising:

a body comprising:

a first channel configured to receive a first lip of the can;

a second channel configured to receive a second lip of the can;

a projection configured to extend into an annular recess of the can positioned between the first lip and the second lip, wherein the projection has a width substantially similar to a width of the annular recess to form a seal between the first lip and the second lip;

a guard wall projecting laterally from the body; and a ramp at least partially defined by a first distal end of the projection, the ramp being coupled to an inner portion of the guard wall, the ramp and the projection being positioned such that, in response to the body being moved along the annular recess of the can, debris residing in the annular recess is forced up the ramp and towards an interior chamber of the can.

21. A squeegee apparatus configured to attach to a can, comprising:

a body comprising:

a first channel configured to receive a first lip of the can;

a second channel configured to receive a second lip of the can, wherein the second channel comprises a protrusion projecting laterally from a surface wall, the protrusion being configured to engage a bottom surface of an inner lip of the can;

a projection configured to extend into an annular recess of the can positioned between the first lip and the second lip;

a guard wall projecting laterally from the body; and a ramp at least partially defined by a first distal end of the projection, the ramp being coupled to an inner portion of the guard wall, the ramp and the projection being positioned such that, in response to the body being moved along the annular recess of the can, debris residing in the annular recess is forced up the ramp and towards an interior chamber of the can.

22. The squeegee apparatus of claim 21, wherein the can is a paint can and the debris is paint residing in the annular recess of the paint can.

* * * * *